US010109290B2

(12) United States Patent
Kjems et al.

(10) Patent No.: US 10,109,290 B2
(45) Date of Patent: Oct. 23, 2018

(54) MULTI-BAND NOISE REDUCTION SYSTEM AND METHODOLOGY FOR DIGITAL AUDIO SIGNALS

(71) Applicant: Retune DSP ApS, Kongens Lyngby (DK)

(72) Inventors: Ulrik Kjems, Frederiksberg (DK); Thomas Krogh Andersen, Tisvildeleje (DK)

(73) Assignee: Retune DSP ApS, Kongens Lyngby (DK)

( * ) Notice: Subject to any disclaimer, the term of this patent is extended or adjusted under 35 U.S.C. 154(b) by 0 days.

(21) Appl. No.: 15/318,046

(22) PCT Filed: Jun. 10, 2015

(86) PCT No.: PCT/EP2015/062924
§ 371 (c)(1),
(2) Date: Dec. 12, 2016

(87) PCT Pub. No.: WO2015/189261
PCT Pub. Date: Dec. 17, 2015

(65) Prior Publication Data

US 2017/0125033 A1 May 4, 2017

(30) Foreign Application Priority Data

Jun. 13, 2014 (EP) ..... 14172412

(51) Int. Cl.
*G10L 21/0232* (2013.01)
*G10L 21/0316* (2013.01)
*G10L 21/038* (2013.01)

(52) U.S. Cl.
CPC ..... *G10L 21/0232* (2013.01); *G10L 21/038* (2013.01); *G10L 21/0316* (2013.01)

(58) Field of Classification Search
CPC ..... G10L 21/0208; G10L 25/21
See application file for complete search history.

(56) References Cited

U.S. PATENT DOCUMENTS 6,098,038 A * 8/2000 Hermansky ..... G10L 21/0208 704/226
7,058,572 B1 * 6/2006 Nemer ..... G10L 21/0208 704/226

(Continued)

OTHER PUBLICATIONS

Breithaupt C. et al. "Analysis of the Decision-Directed SNR Estimator for Speech Enhancement with respect to Low-SNR and Transient Conditions." IEEE Transactions on Audio, Speech and Language Processing, IEEE 2010, IEEE Service Center, NY USA, vol. 19, No. 2, Feb. 1, 2011, pp. 277-289, XP011307079.

(Continued)

*Primary Examiner* — Brian L Albertalli
(74) *Attorney, Agent, or Firm* — Crawford Maunu PLLC

(57) ABSTRACT

The present invention relates to a multi-band noise reduction system for digital audio signals producing a noise reduced digital audio output signal from a digital audio signal. The digital audio signal comprises a target signal and a noise signal, i.e. a noisy digital audio signal. The multi-band noise reduction system operates on a plurality of sub-band signals derived from the digital audio signal and comprises a second or adaptive signal-to-noise ratio estimator which is configured for filtering a plurality of first signal-to-noise ratio estimates of the plurality of sub-band signals with respective time-varying low-pass filters to produce respective second signal-to-noise ratio estimates of the plurality of sub-band signals. A low-pass cut-off frequency of each of the time-varying low-pass filters is adaptable in accordance with a first signal-to-noise ratio estimate determined by a first signal-to-noise ratio estimator and/or the second signal-to-noise ratio estimate of the sub-band signal.

12 Claims, 7 Drawing Sheets

(56) References Cited

U.S. PATENT DOCUMENTS

| | | | | |
|---|---|---|---|---|
| 8,244,523 | B1 * | 8/2012 | Murphy | G10L 25/84 381/71.11 |
| 8,521,530 | B1 | 8/2013 | Every et al. | |
| 2009/0119111 | A1 * | 5/2009 | Goto | G10L 19/008 704/500 |
| 2013/0191118 | A1 | 7/2013 | Makino | |
| 2015/0142425 | A1 * | 5/2015 | Sjoberg | G10L 21/0364 704/226 |

OTHER PUBLICATIONS

Ephraim Y. et al. "Speech enhancement using a minimum mean-square error log-spectral amplitute estimator." IEEE Transactions on Acoustics, Speech and Signal Processing, vol. 33, No. 2, pp. 443-445, Apr 1985.

Ephraim Y. "Speech enhancement using a minimum-mean square error short-time spectral amplitude estimator." IEEE Transactions on Acoustics, Speech and Signal Processing, vol. 32, No. 6, pp. 1109-1121, Dec. 1984.

Martin R. "Noise power spectral density estimation based on optimal smoothing and minimum statistics." IEEE Transactions on Speech and Audio Processing, vol. 9, No. 5, pp. 504-512, Jul. 2001.

Loizou, Philipos C. Speech Enhancement: Theory and Practice. CRC Press, Inc., Boca Raton, FL, USA, 711 pgs. (2013). ISBN:1466504218 9781466504219. Abstract only.

Olivier Cappé. "Elimination of the Musical Noise Phenomenon with the Ephraim and Malah Noise Suppressor." IEEE Transactions on Speech and Processing, vol. 2, No. 2, pp. 345-349 (Apr. 1994).

* cited by examiner

A)

B)

MULTI-BAND NOISE REDUCTION SYSTEM AND METHODOLOGY FOR DIGITAL AUDIO SIGNALS

The present invention relates to a multi-band noise reduction system for digital audio signals producing a noise reduced digital audio output signal from a digital audio signal. The digital audio signal comprises a target signal and a noise signal, i.e. a noisy digital audio signal. The multi-band noise reduction system operates on a plurality of sub-band signals derived from the digital audio signal and comprises a second or adaptive signal-to-noise ratio estimator which is configured for filtering a plurality of first signal-to-noise ratio estimates of the plurality of sub-band signals with respective time-varying low-pass filters to produce respective second signal-to-noise ratio estimates of the plurality of sub-band signals. A low-pass cut-off frequency of each of the time-varying low-pass filters is adaptable in accordance with a first signal-to-noise ratio estimate determined by a first signal-to-noise ratio estimator and/or the second signal-to-noise ratio estimate of the sub-band signal.

BACKGROUND OF THE INVENTION

Research in signal processing systems, methods and algorithms for suppressing or removing noise signals of a noise infected target signal, such as a speech signal, has been on-going for decades. Important objectives of these efforts are to provide an improvement in the perceived sound quality and/or speech intelligibility for the listener. In voice communication apparatuses and systems it is known to represent a noisy speech signal in a time-frequency domain, e.g. as multiple sub-band signals. In many cases it is desirable to apply a time-frequency dependent gain value to the sub-band signals before the signal is reconstructed as a time domain signal. This is done to attenuate the undesired noise signal components that may be present in an audio signal. These time-frequency dependent gain values or time-varying sub-band gain values are sometimes derived from an estimate of the time-frequency dependent ratio of target signal and noise signal. The present multi-band noise reduction system and methodology may comprise processing multiple time-frequency signal-to-noise ratio estimates of respective sub-band signals to improve the sound quality and/or intelligibility of target speech for a listener or user in a manner to take into account the statistical properties of a background noise signal and the nature of natural speech. The result of the processing may provide respective improved signal-to-noise ratio (SNR) estimates of the sub-band signals to be used for calculating appropriate time-frequency gain values.

The present multi-band noise reduction system and methodology have numerous applications in addition to the previously discussed sound quality and/or speech intelligibility improvements. The multi-band noise reduction system and methodology may form part of front-ends of voice control or speech recognition systems which benefit by the improved signal-to-noise ratio (SNR) of the noise reduced digital audio output signal. The invention may e.g. be useful in applications such as hands-free systems, headsets, hearing aids, active ear protection systems, mobile telephones, teleconferencing systems, karaoke systems, public address systems, mobile communication devices, hands-free communication devices, voice control systems, car audio systems, navigation systems, audio capture, video cameras, and video telephony. The improved SNR of the noise reduced digital audio output signal may be used to provide noise reduction, speech enhancement or suppression of residual echo signals in an echo cancellation system. The improved SNR of the noise reduced digital audio output signal may also be exploited to improve the recognition rate in a voice control system.

Traditional methods for enhancing the quality of a noise infected target signal include beamforming and noise reduction techniques. Single channel noise reduction algorithms can operate on a communication signal, for example, a single microphone audio signal or on a beam-formed signal which is the result of a beamforming operation on multiple microphone audio signals. This invention can be used as part of a noise reduction system in either case.

It is assumed in the following that an analysis filterbank is in place processing a time domain signal y(t). An example is a complex DFT filterbank according to:

$$Y_k(n) = \sum_{l=0}^{L-1} y(nD - l) w_A(l) e^{-2\pi jkl/L} \tag{1}$$

where k designates a subband index, n is the frame (time) index, $w_A(l)$ is the analysis window function, L is the frame length, and D is the filterbank decimation factor. In other implementations, the noise subband signal $Y_k(n)$ may be available as a result of other processing steps, such as beamforming, echo cancellation, wind noise reduction, etc.

It is common for noise reduction systems to operate on the principle of estimating an SNR in the time-frequency domain; for example the maximum likelihood SNR estimate $\xi_k^{ML}(n)$ is defined as $$\xi_k^{ML}(n) = \max\left(0, \frac{|Y_k(n)|^2}{\hat{\sigma}_k^2(n)} - 1\right) \tag{2}$$

Here, $\hat{\sigma}_k^2(n)$ is a noise power density estimator, obtained from a noise estimator algorithm, of which a multitude are known [4], and will not be described here. Because the maximum likelihood SNR estimate can be fluctuating and because it is a biased (i.e. non-central) estimator, it is common to introduce a further processing step known as decision directed processing (DD) [1]. In DD, an a priori SNR estimate $\xi_k(n)$ is introduced, as $$\xi_k(n) = \alpha \frac{\hat{A}_k(n-1)^2}{\hat{\sigma}_k^2(n)} + (1-\alpha)\xi_k^{ML}(n) \tag{3}$$

Here, $\alpha$ is a weighting parameter (usually chosen in the range 0.94 . . . 0.99), $\hat{A}_k(n)^2$ is the speech magnitude estimate, based on a speech estimator algorithm, of which a multitude exists [3][4], in general $$\hat{A}_k(n)^2 = G\left(\xi_k(n) \frac{|Y_k(n)|^2}{\hat{\sigma}_k^2(n)}\right) |Y_k(n)| \tag{4}$$

where the function G(•, •) is known as a gain function. Well known examples of gain functions are Wiener filter, spectral subtraction, and more advanced methods such as STSA [1], LSA and MOSIE [2]. Because of their complexity, practical embodiments of such gain functions require storage of a two-dimensional lookup-table.

The output signal is reconstructed from the estimated spectral magnitudes $\hat{A}_k(n)^2$ and the noisy phases $\angle Y_k(n)$ using a synthesis filterbank. It is well known that the maximum likelihood SNR estimate a $\xi_k^{ML}(n)$ is not a central estimator. This is due to the truncation of negative values. FIG. 4 shows the bias in an experiment where noise samples were generated at SNR values corresponding to the x-axis, and the average estimate $\xi_k^{ML}(n)$ is graphed. The DD approach is known for, when used in combination with certain gain functions, introducing a negative bias that to a certain extent counter-acts the bias of the maximum likelihood estimator [3]. The DD approach is further known for effectively introducing temporal averaging the SNR estimate when the SNR is low [3].

One significant disadvantage of the DD approach is that the interaction between the chosen component algorithms, i.e. the particular type of speech and noise estimator applied and which gain function is used is unclear. It is not generally possible to compensate for any differences that arise if, say, the gain function is replaced. Even basic parameters such as the filterbank parameters D and L and signal sample rate all can have a large influence on the sound quality of the resulting output. The present invention has advantages over the traditional DD approach, by allowing to compensate for system parameters, and noise estimator and speech estimator properties, and further allows the SNR processing to be adapted to properties relating to the noise environment. It is able to act in many aspects similarly to the DD-approach for a given setup, and it further allows tuning to be made, and extends support to filterbank configurations that would not work well using DD.

SUMMARY OF THE INVENTION

A first aspect of the invention relates to a multi-band noise reduction system or processor for digital audio signals, comprising:

a signal input for receipt of a digital audio input signal comprising a target signal and a noise signal, an analysis filter bank configured for dividing the digital audio input signal into a plurality of sub-band signals $Y_k(n)$, a noise estimator configured for determining respective sub-band noise estimates $\hat{\sigma}_k^2(n)$ of the plurality of sub-band signals $Y_k(n)$, a first signal-to-noise ratio estimator configured for determining respective first signal-to-noise ratio estimates $\xi_k^0(n)$ of the plurality of sub-band signals based on the respective sub-band noise estimation signals and the respective sub-band signals $Y_k(n)$, a second signal-to-noise ratio estimator configured for filtering the plurality of first signal-to-noise ratio estimates $\xi_k^0(n)$ of the plurality of sub-band signals $Y_k(n)$ with respective time-varying low-pass filters to produce respective second signal-to-noise ratio estimates $\zeta_k(n)$ of the plurality of sub-band signals $Y_k(n)$ wherein a low-pass cut-off frequency of each of the time-varying low-pass filters is adaptable in accordance with the first signal-to-noise ratio estimate and/or the second signal-to-noise ratio estimate of the sub-band signal, a gain calculator configured for applying respective time-varying gains $G_k(n)$ to the plurality of sub-band signals $Y_k(n)$ based on the respective second signal-to-noise ratio estimates $\zeta_k(n)$ and respective sub-band gain laws to produce a plurality of noise compensated sub-band signals, a synthesis filter bank configured to combine the plurality of noise compensated sub-band signals into a noise reduced digital audio output signal at a signal output.

The skilled person will appreciate that the present multi-band noise reduction system may be adapted to reduce the noise of digital audio signals in numerous types of stationary and portable audio enabled equipment such as smartphones, tablets, hearing instruments, head-sets, public address systems etc. The digital audio signal may originate from one or more microphone signals of the above types of stationary and portable audio enabled equipment. The digital audio signal may for example have been derived from a preceding beamforming operation performed on two or more separate microphone signals to produce an initial directional or spatial based noise reduction.

The respective signal processing functions or blocks implemented by the claimed estimators, processors, filter and filter banks etc. of the present multi-band noise reduction system may be performed by dedicated digital hardware or by executable program instructions executed on a microprocessor or any combination of these. The signal processing functions or blocks may be performed as one or more computer programs, routines and threads of execution running on a software programmable signal processor or processors. Each of the computer programs, routines and threads of execution may comprise a plurality of executable program instructions. The signal processing functions may be performed by a combination of dedicated digital hardware and computer programs, routines and threads of execution running on the software programmable signal processor or processors. For example each of the above-mentioned estimators, processors, filter and filter banks etc. may comprise a computer program, program routine or thread of execution executable on a suitable microprocessor, in particular a Digital Signal Processor (DSP). The microprocessor and/or the dedicated digital hardware may be integrated on an ASIC or implemented on a FPGA device.

The analysis filter bank which divides the digital audio input signal into the plurality of sub-band signals may be configured to compute these in various ways, for example, using a block-based FFT algorithm or Discrete Fourier Transform (DFT). Alternatively, time domain filter banks such as ⅓ octave filter banks or Bark scale filter banks may be used for this task. The number of sub-band signals typically corresponds to the number of frequency bands or channels of the analysis filter bank. The number of channels of the analysis filter bank may vary depending on the application in question and a sampling frequency of the digital audio signal. For a 16 kHz sampling frequency of the digital audio signal, the analysis filter bank may comprise between 16 and 128 frequency bands generating between 16 and 128 sub-band signals. The synthesis filter bank may comprise the same number of frequency bands.

The second signal-to-noise ratio estimator may be configured to, for each of the plurality of sub-band signals $Y_k(n)$, increase the low-pass cut-off frequency of the time-varying low-pass filter with increasing values of the first and/or second signal-to-noise ratio estimates of the sub-band signal.

This embodiment produces a long time constant or a small low-pass cut-off frequency for the low-pass filtration of the first signal-to-noise ratio estimate such that small random fluctuations of an essentially pure noise sub-band signal, i.e. without any speech signal components, are effectively suppressed. This prevents such small random fluctuations from being detected as a target signal which could produce audible and perceptually objectionable modulation of the noise reduced digital audio output signal. On the other hand under high SNR conditions of the sub-band signal in question, i.e. where a large target signal component is present in the sub-band signal, the second signal-to-noise ratio estimator produces a relatively shorter time constant or a higher low-pass cut-off frequency setting of the time-varying low-pass filter. This relatively shorter time constant allows the second signal-to-noise ratio estimator to react rapidly to a transition from the high SNR condition to a low SNR condition.

Each of the plurality of time-varying low-pass filters may comprise an IIR filter structure wherein an input of the IIR filter structure is coupled to the first signal-to-noise ratio estimate and an output of the IIR filter structure produces the second signal-to-noise ratio estimate. The low-pass cut-off frequency of each of the time-varying low-pass filters may be adaptable in accordance with the first signal-to-noise ratio estimate of the sub-band signal or the second signal-to-noise ratio estimate of the sub-band signal or a combination of both as discussed in further detail below with reference to FIG. 2 of the appended drawings.

One embodiment of the IIR filter structure comprises:

a first input summing node configured for receipt of the first signal-to-noise ratio estimate, an output node supplying the second signal-to-noise ratio estimate, a unit delay function coupled to the output node and configured to supply a delayed second signal-to-noise ratio estimate to the first input summing node, the input summing node configured to combine an output signal of the first input summing node and the delayed second signal-to-noise ratio estimate to generate a first intermediate signal, a multiplication function configured to multiply the first intermediate signal and a limited delayed second signal-to-noise ratio estimate to generate a second intermediate signal, a first intermediate summing node configured to combine the second intermediate signal and the delayed second signal-to-noise ratio estimate, a maximum operator configured for:

at a first input, receipt of the delayed second signal-to-noise ratio estimate and at a second input, receipt of the first signal to noise-ratio estimate or a look-ahead estimate of the first signal to noise-ratio estimate, generating a maximum signal-to-noise ratio estimate from the first and second inputs;

a first feedback path configured to couple a first time-varying portion of the maximum signal-to-noise ratio estimate to the multiplication function by a time-varying transfer coefficient of a first monotonic function in accordance with the first signal-to-noise ratio estimate of the sub-band signal. The numerous advantages of this IIR filter structure is described in detail below in connection with the appended drawings.

The recursive IIR filter structure may additionally comprise:

a second input summing node arranged in front of the first input summing node and configured for receipt of the first signal-to-noise ratio estimate and a second time-varying portion of the limited delayed second signal-to-noise ratio estimate, a second feedback path configured to couple the second time-varying portion of the limited delayed second signal-to-noise ratio estimate to the second input summing node by a second monotonic function in accordance with a time-varying transfer coefficient value derived from the first signal-to-noise ratio estimate of the sub-band signal.

The multi-band noise reduction system may comprise a monotonic compressive function C(x) arranged in front of the second signal-to-noise ratio estimator and configured for mapping a numerical range of each of the plurality of first signal-to-noise ratio estimates $\xi_k^0(n)$ into a smaller output numerical range before application to the second signal-to-noise ratio estimator. The multi-band noise reduction system further comprises a monotonic expansive function $C^{-1}(x)$, possessing an inverse transfer characteristic of the monotonic compressive function, arranged after the second signal-to-noise ratio estimator. The monotonic expansive function $C^{-1}(x)$ is preferably configured for mapping a numerical range of each of the plurality of second signal-to-noise ratio estimates $\zeta_k(n)$ into a larger output numerical range before application to the gain calculator.

The monotonic compressive function C(x) may for example comprise a logarithmic function as described in detail below in connection with the appended drawings. In an alternative set of embodiments, the monotonic compressive function C(x) comprises a non-logarithmic function such as:

$$C(x)=10P(x^{1/P}-1)/\log 10,$$

where P>1 and is a positive real number.

The gain calculator may apply various types of sub-band gain laws to determine the respective time-varying gains of the plurality of sub-bands signals. The gain calculator may for example be configured to compute the respective time-varying gains $G_k(n)$ of the plurality of sub-band signals $Y_k(n)$ according to:

$$G_k(n) = \max\left(G_{min}, \frac{\xi_k(n)}{\xi_k(n)+1}\right);$$

wherein $G_{min}$ is a predetermined minimum gain value between 0.01 and 0.2.

A second aspect of the invention relates to a method of reducing noise of a digital audio signal comprising a target signal and a noise signal, comprising steps of:

a) dividing or splitting the digital audio input signal into a plurality of sub-band signals $Y_k(n)$, b) determining respective sub-band noise estimates $\hat{\sigma}_k^2(n)$ of the plurality of sub-band signals $Y_k(n)$, c) determining respective first signal-to-noise ratio estimates $\xi_k^0(n)$ of the plurality of sub-band signals based on the respective sub-band noise estimation signals and the respective sub-band signals $Y_k(n)$, d) filtering the plurality of first signal-to-noise ratio estimates $\xi_k^0(n)$ of the plurality of sub-band signals $Y_k(n)$ with respective time-varying low-pass filters to produce respective second signal-to-noise ratio estimates $\zeta_k(n)$ of the plurality of sub-band signals $Y_k(n)$ wherein a low-pass cut-off frequency of each of the time-varying filters is adapted in accordance with the first signal-to-noise ratio estimate of the sub-band signal, e) applying respective time-varying gains $G_k(n)$ to the plurality of sub-band signals $Y_k(n)$ based on the respective second signal-to-noise ratio estimates $\zeta_k(n)$ and respective sub-band gain laws to produce a plurality of noise compensated sub-band signals, f) combining the plurality of noise compensated sub-band signals into a noise reduced digital audio output signal at a signal output.

The method of reducing noise of a digital audio input signal may comprise further steps of:

before step d) mapping a numerical range of each of the plurality of first signal-to-noise ratio estimates $\xi_k^0(n)$ into a smaller output numerical range in accordance with a monotonic compressive function; and before step e) mapping a numerical range of each of the plurality of second signal-to-noise ratio estimates $\zeta_k(n)$ into a larger output numerical range in accordance with a monotonic expansive function possessing an inverse transfer characteristic of the monotonic compressive function.

A third aspect of the invention relates to a computer readable data carrier comprising executable program instructions configured to cause a programmable signal processor to execute each of the above-mentioned method steps a)-f). The computer readable data carrier may comprise a magnetic disc, optical disc, memory stick or any other suitable data storage media.

A fourth aspect of the invention relates to a portable communication device comprising:

a first microphone for generation of a first microphone signal in response to receipt of sound, an audio input channel coupled to the first microphone signal and configured to generate a corresponding digital audio signal, a multi-band noise reduction system according to any of the above-described embodiments thereof coupled or connected to the digital audio signal. The portable communication device may comprise a sound reproduction channel coupled to the noise reduced digital audio output signal and conversion into audible sound for transmission to the user of the portable communication device.

BRIEF DESCRIPTION OF THE DRAWINGS

Embodiments of the invention will be described in more detail in connection with the appended drawings in which.

DESCRIPTION OF PREFERRED EMBODIMENTS

Figure 1:
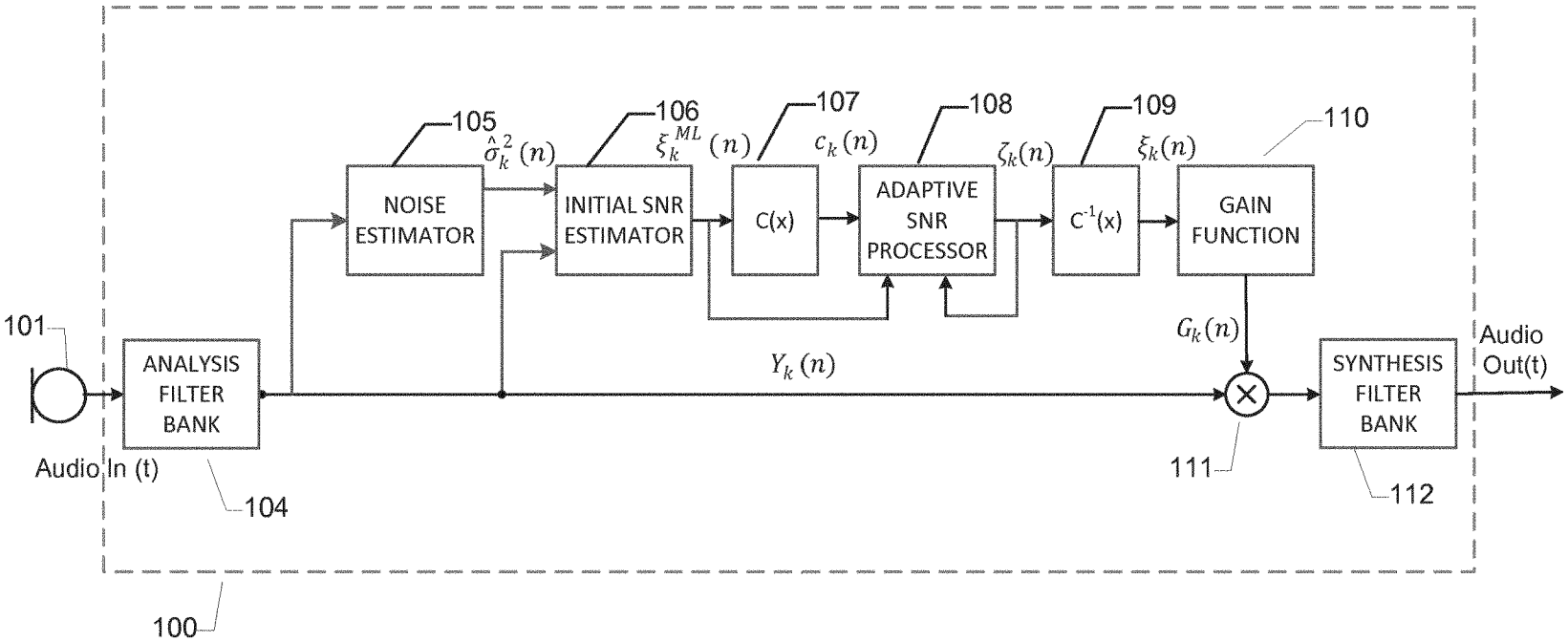
FIG. 1 is a schematic block diagram of a multi-band noise reduction system in accordance with a first embodiment of the present invention.

FIG. 1 is a schematic block diagram of a multi-band noise reduction system 100 in accordance with a first embodiment of the present invention. A microphone 101 picks up a noise infected acoustic signal from the surrounding environment and generates a digital audio input signal Audio ln(t) to an analysis filter bank 104. The digital audio input signal comprises a mixture of a target signal, for example speech and a noise signal. The origin of the noise signal, and spectral and temporal characteristics of the noise signal, may differ widely depending on the noise source or sources and the acoustic environment in which the microphone 101 is situated.

The present methodology and system for reducing noise of a digital audio signal comprising a target signal and a noise signal may include an adaptive processing of a plurality of initial or first signal-to-noise ratio (SNR) estimates of a plurality of sub-band signals resulting in a plurality second or adaptive signal-to-noise ratio (SNR) estimates. A temporal smoothing, or low-pass filtration, of each of the plurality of first SNR estimates is preferably achieved at low SNR values of the sub-band signal in question. A low SNR value of the sub-band signal may be SNR values below any of +3 dB, 0 dB and −3 dB. An optional negative bias may be introduced as well. The temporal smoothing of each of the plurality of first SNR estimates improves sound quality of a noise reduced digital audio output signal by reducing or making inaudible otherwise undesired sound artefacts. It is a further advantage of the invention that certain mechanisms may be utilized for preserving speech transients by permitting the second SNR estimates to change rapidly from a low SNR condition to high SNR condition and vice versa.

It is an advantage of the present multi-band noise reduction system and processing methodology that a number of system parameters such as sample rate of the digital audio signal, analysis filter bank oversampling, choice of sub-band gain functions or laws, and noise estimator methods, as well as speech and noise characteristics can be taken into account. This feature may lead to an improved sound quality in the enhanced audio signal, or may improve the recognition rate of an automated voice control system connected to the signal output of the present multi-band noise reduction system for receipt of the generated noise reduced digital audio output signal. Furthermore, the present multi-band noise reduction system and associated processing methodology will require less DSP computing resources of a microprocessor in terms of processing power and memory compared to prior art approaches such as a direct computation of the previously discussed decision directed processing according to equations (3) and (4).

A preferred embodiment of the present multi-band noise reduction system 100 for digital audio signals is illustrated on FIG. 1. A noise contaminated digital audio signal supplied by a digital microphone 101 is processed by an analysis filter bank 104 to obtain a plurality of sub-band signals Y_k (n) where n is a filter bank frame index corresponding to time t. A noise estimator 105 is used to determine or compute a noise estimate σ^_kΛ2 (n) of each of the plurality of sub-band signals Y_k (n). Several noise estimator methods which are known in the art may be applied for this purpose such as the so-called minimum statistics method [5].

Based on the noise estimate and the sub-band noise contaminated signal for each of the plurality of sub-band signals, a first or initial SNR estimates [(ξ_k)]Λ0 (n) are obtained using an initial or first SNR estimator 106. In the present exemplary embodiment, the first SNR estimator comprises a bounded maximum likelihood estimate of the power ratio between target signal speech and noise signal:

$$\xi_k^{ML}(n) = \max\left\{\xi_{min}^{ML}, \frac{|Y_k(n)|^2}{\hat{\sigma}_k^2(n)} - 1\right\} \tag{5}$$

where the function max(a, b) selects the larger one of the numbers a and b, and $\xi_{min}^{ML}$ is a positive lower bound, such as a value between 0.01 and 0.05.

This sub-band first noise estimate may optionally be processed by a compressive monotonic function C(x) (107) for each sub-band. The compressive monotonic function C(x) may for example comprise the function $C(x)=10P(x^{1/P}-1)/\log 10$, where P>1 is a positive, real number. In some embodiments, it may be advantageous with a relatively smaller value of P, such as P=4 to emphasize transients of the sub-band signal in subsequent signal processing. Alternative embodiments of the compressive monotonic function C(x) may utilize relatively large values of P such as P=32 to place less emphasis on transients of the sub-band signal.

The factor 10P/log 10 in the above example is chosen such that C(x) becomes a $1^{st}$ order approximation to the function $C_{dB}(x)=10\log_{10}(x)$, around a point $x_0=1$. This choice makes compressed SNR estimates interpretable as approximate values in dB, although the chosen value of P allows more emphasis on transient high SNR values compared to the case of $C(x)=C_{dB}(x)$.

Figure 6:
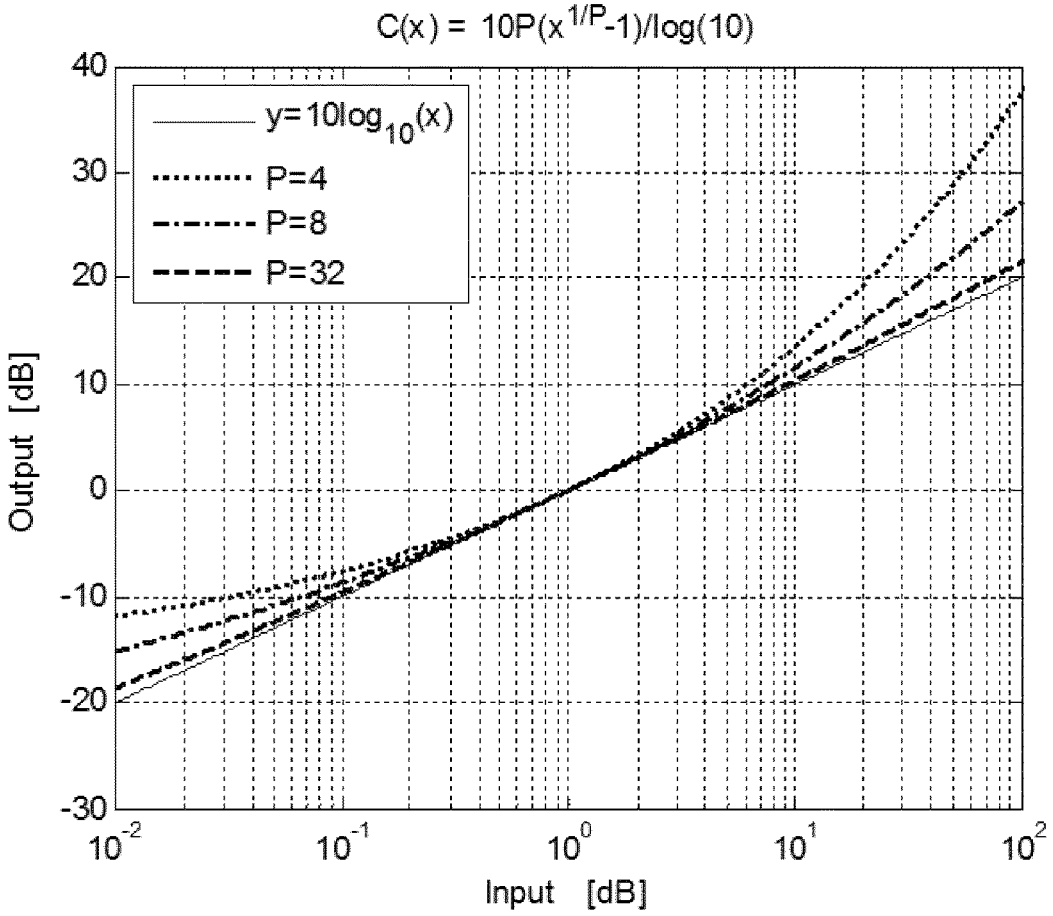
FIG. 6 shows input-output mapping characteristics or curves of a number of exemplary monotonic compressive functions C(x)

FIG. 6 shows an input-output plot of C(x) for three values of P and corresponding input-output plot of $C_{dB}(x)$ for comparison purposes.

The resulting compressed first SNR estimate $c_k(n)=C(\xi_k^0(n))$ may be used as input $d_k(n)$ to a second signal-to-noise ratio estimator 108 with certain adaptive properties.

Figure 2:
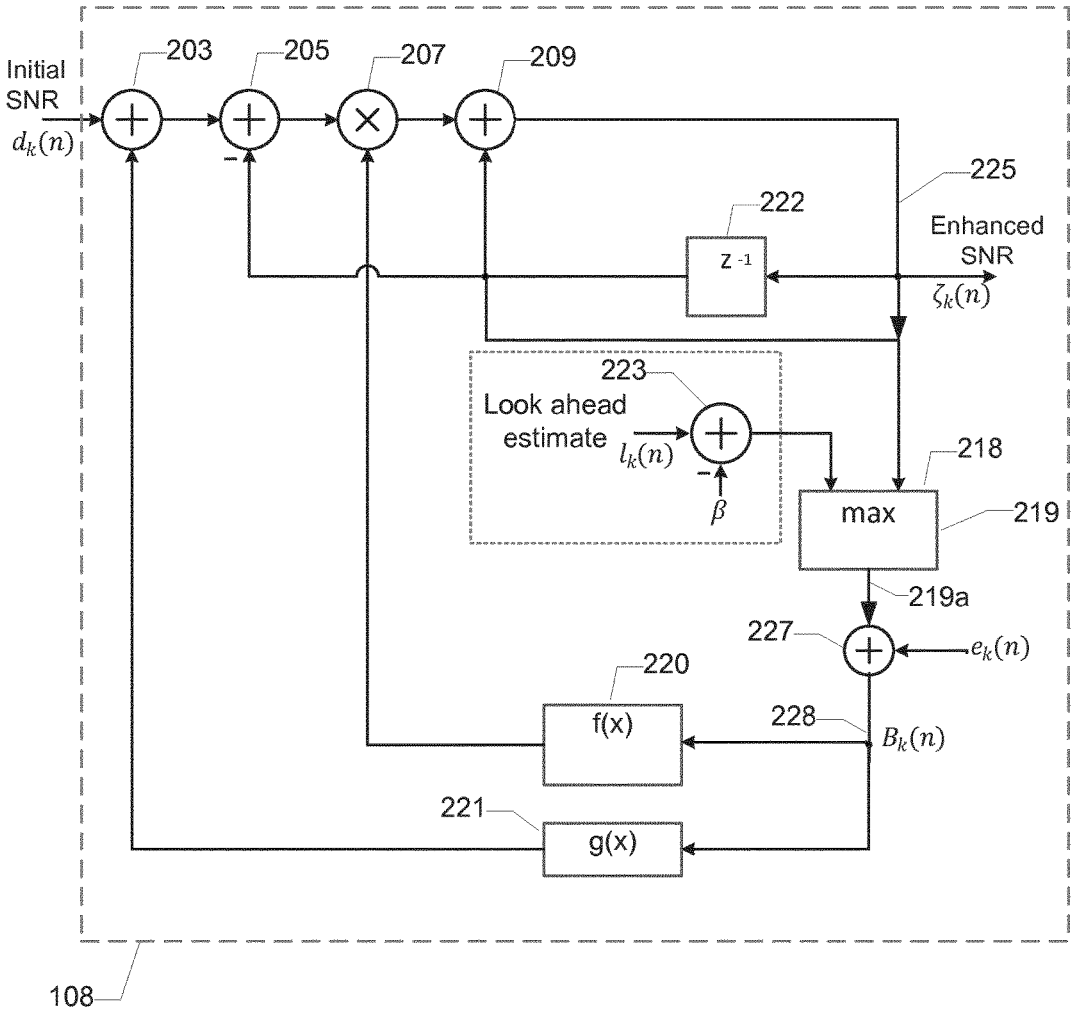
FIG. 2 shows a simplified schematic block diagram of a second or adaptive signal-to-noise ratio estimator for use in the multi-band noise reduction system of FIG. 1.

FIG. 2 shows a schematic block diagram of a preferred embodiment of the second SNR estimator or processor 108 for processing a single sub-band signal. The second SNR estimator or processor 108 produces a plurality of second signal-to-noise ratio estimates $\zeta_k(n)$ for respective ones of the plurality of sub-band signals.

The second signal-to-noise ratio for a sub-band is derived by means of a time-varying recursive low-pass filtering of the first or initial SNR estimate (or the compressed first SNR estimate $d_k(n)$) of the sub-band signal in question, e.g. sub-band k according to:

$$\zeta_k(n)=\zeta_k(n-1)+f(B_k(n))(d_k(n)+g(B_k(n))-\zeta_k(n-1)), \tag{6}$$

where $$B_k(n)=\max(l_k(n)-\beta,\zeta_k(n-1))+e_k(n), \tag{7}$$

and f(x) 220 is a first monotonic function bounded by $0\leq f(x)\leq 1$ controlling temporal smoothing of the first SNR estimate. The function g(x) (221) is a second monotonically increasing function controlling an additive negative SNR bias, $l_k(n)$ is an optional look-ahead SNR estimate, β is a predetermined look-ahead sensitivity constant of the optional look-ahead function, and $e_k(n)$ is an optional sound environment control signal. If the depicted look-ahead estimate is discarded then its input may instead be connected to $d_k(n)$, so that $l_k(n)=d_k(n)$.

The recursive structure has resemblance to, and may also comprise, a first order time-varying IIR low-pass filter in accordance with:

$$y(n)=y(n-1)+\lambda(x(n)-y(n-1)) \tag{8}$$

This first order time-varying IIR low-pass filter has a transfer function:

$$Y(z)=\frac{\lambda}{1-(1-\lambda)z^{-1}}, \tag{9}$$

which corresponds to a low-pass filter with a unit gain at 0 Hz, and a pole at $z=1-\lambda$ which also determines a corresponding low-pass cut-off frequency of time-varying IIR filter. Therefore, the second SNR estimator or processor can be seen to introduce a time-varying low pass filtering of the first SNR estimate by means of the filter coefficient $\Delta=f(B_k(n))$.

The first monotonic function f(x) is preferably chosen such that is possesses a relatively small transfer coefficient value at low values of the first and/or second signal-to-noise ratio estimates of the sub-band signal and a relatively large coefficient value, e.g. between 0.9 and 1.0, for high values of the first and/or second signal-to-noise ratio estimates. Thereby, a SNR dependent time-varying averaging or adaptive smoothing of the first SNR estimate is achieved.

An exemplary embodiment of f(x) comprises a logistic function:

$$f(x)=f_0+\frac{1-f_0}{1+\exp(-4a(x-x_{f,0}))} \tag{10}$$

Figure 3:
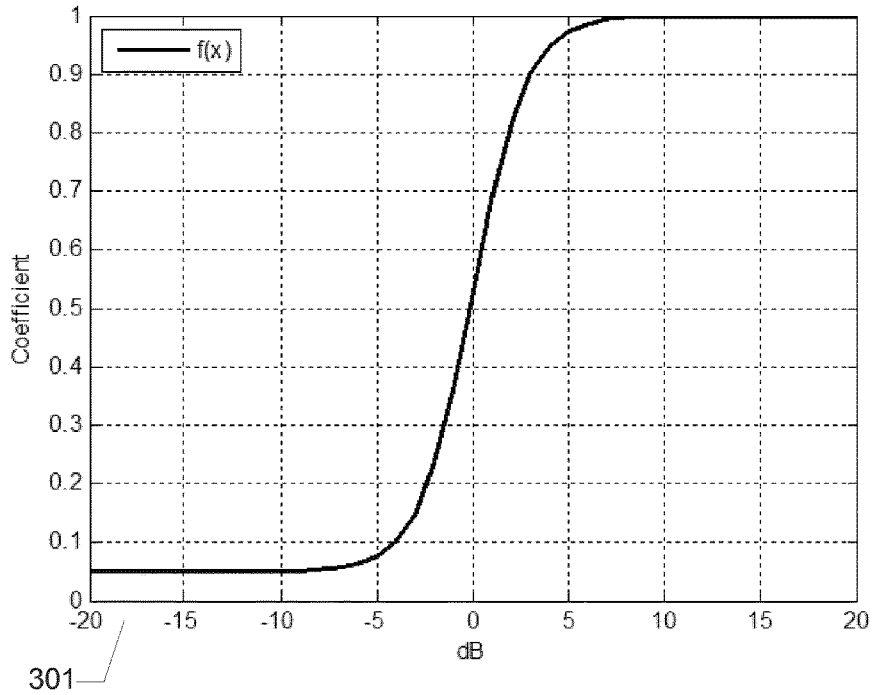
FIG. 3 shows plots of a first monotonic function f(x) and a monotonic function g(x) of the second signal-to-noise ratio estimator depicted on FIG. 2.
Figure 3:
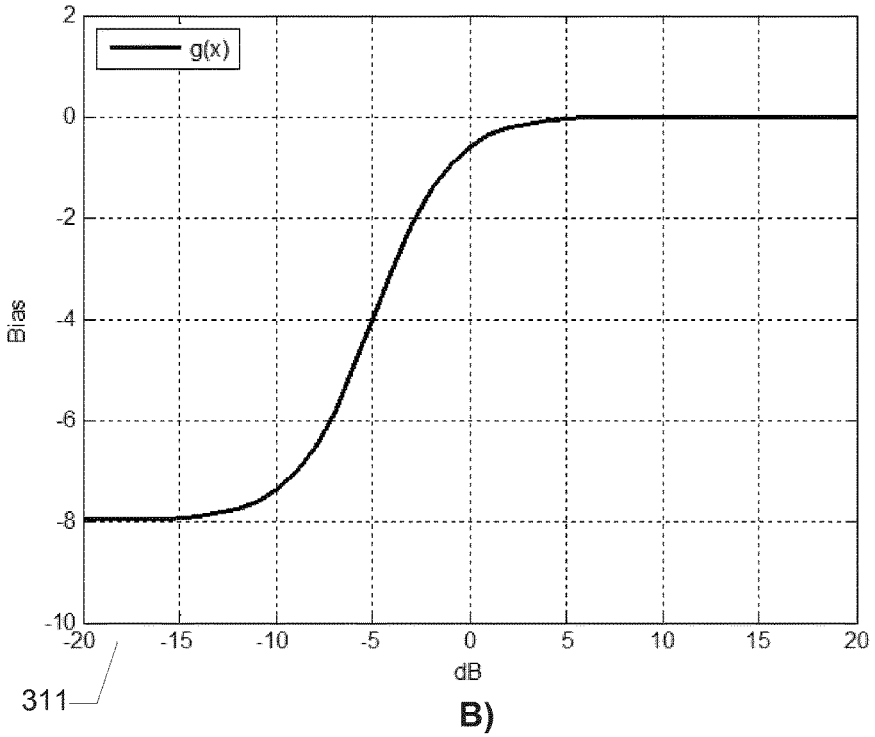
Figure 4:
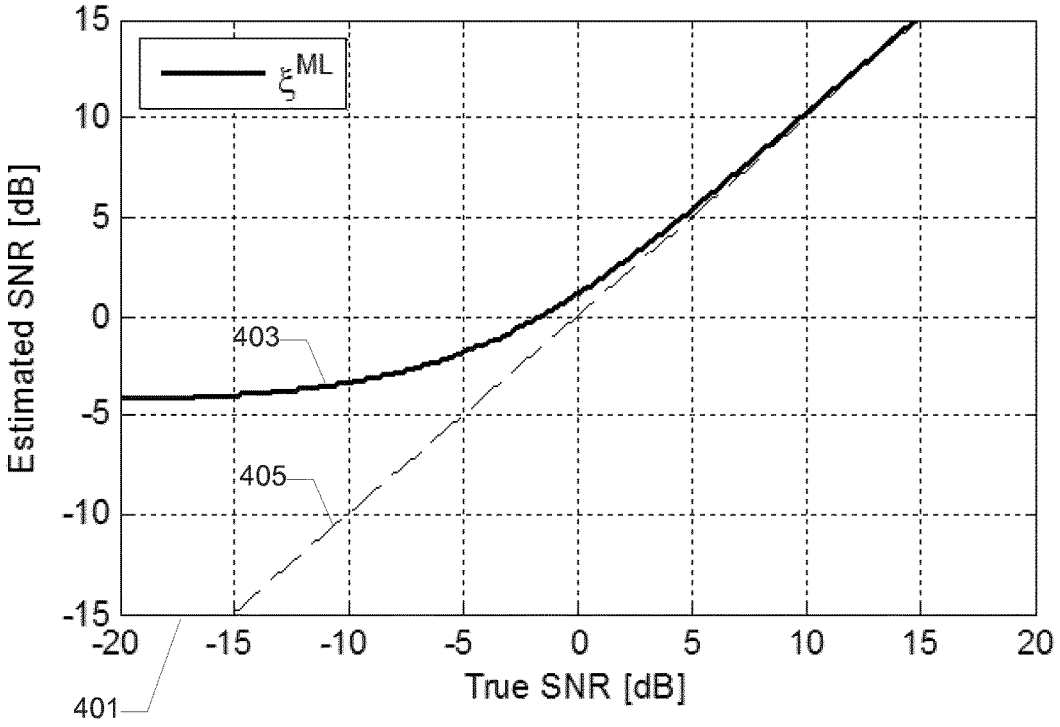
FIG. 4 shows a plot of a true second signal-to-noise ratio of a sub-band signal versus an estimated signal-to-noise ratio of the second signal-to-noise ratio estimator.

Exemplary parameters of f(x) are $f_0=0.05$, maximum slope parameter a=0.18 and midpoint $x_{f,0}=0$. This exemplary parameter set of f(x) is graphed in FIG. 3A), graph 301. The asymptotic values of f(x) for the previously discussed low and high SNR estimates are $f_0$ and 1.0, respectively. At high SNR estimates, which may be SNR values larger than 5 dB, or larger than 8 dB, essentially no temporal smoothing of the first SNR estimate occurs. These conditions may correspond to a low-pass cut-off frequency of the first order time-varying IIR filter larger than 50 Hz, or larger than 100 Hz, or even larger than 200 Hz.

Conversely, at negative SNR estimates, which may be SNR values smaller than −5 dB, or −8 dB, a pronounced temporal smoothing or averaging of the first SNR estimate occurs. The corresponding averaging time constant is about $$\tau(f_0)=-\frac{1}{f_{frame}\log(1-f_0)}=194\ \text{ms}$$

for an exemplary filterbank frame rate of $f_{frame}=100$ Hz.

This averaging time constant corresponds to a low-pass cut-off frequency of approximately 1 Hz. The skilled person will understand that this low-pass cut-off frequency may vary under the above-mentioned negative SNR estimates. The low-pass cut-off frequency may be smaller than 5 Hz, or smaller than 2 Hz or even more preferably smaller than 1 Hz for SNR values smaller than −5 dB.

A negative bias is further introduced by means of the optional function g(x) (221) by the term $g(B_k(n))$. The amount of bias is controlled by the function g(x), which in an exemplary embodiment is implemented as a logistic function $$g(x)=g_0+\frac{-g_0}{1+\exp(-4b(x-x_{g,0}))} \tag{11}$$

Exemplary parameters of g(x) are $g_0=8.0$ dB, b=0.125 and sigmoid centre $x_{g,0}=5.0$ dB. This exemplary g(x) function is graphed on FIG. 3B), graph 311.

The role of the optional look-ahead SNR estimate $l_k(n)$ is to aid in a transition from a relatively low value of the second SNR estimate to a relatively high value of the second SNR estimate for example corresponding to the previously discussed SNR value ranges associated with each of these conditions. This transition aid may be utilized to remove any recursive negative bias that may be in effect when a transient or onset occurs in the digital audio signal. For example, after a period of speech absence in the digital audio signal, the second SNR estimate attains a low value, and the time-varying IIR low-pass filter attains a long time constant due to the function $\lambda=f(B_k(n))$ attaining a small value. In addition, the bias term $g(B_k(n))$ may be attaining a negative value close to $g_0$. Both the bias and smoothing operation prevent a rapid change of the second SNR estimate even if a signal transient of high SNR value is accounted for by the first SNR estimate. The look-ahead SNR estimate $l_k(n)$ will, through the maximum operator 219 allow a speech transient to override the long time constant (increasing $\lambda$) and also override the bias (increasing $g(B_k(n))$ towards zero bias). This action will in turn allow the second SNR estimate to react quickly to the signal transient leading to an increasing first SNR estimate and therefore preventing undesired attenuation of the speech transient.

Consequently, the output 219*a* of the maximum operator 219 controls whether the low-pass cut-off frequency of the time-varying low-pass filter of the SNR estimator 108 in question is adapted in accordance with the first SNR estimate of the sub-band signal or the second SNR estimate of the sub-band signal or both of the first and SNR estimates. Hence, the maximum operator 219 implements an operation between the first SNR estimate and the second SNR estimate with respect to which one of these variables that sets the low-pass cut-off frequency of the time-varying low-pass filter. Hence, during some time periods of operation of the present multi-band noise reduction system 100 the low-pass cut-off frequency of the time-varying low-pass filter may be controlled by the second SNR estimate and during other time periods controlled by the first SNR estimate.

The look-ahead SNR estimate $l_k(n)$ may correspond to a maximum of a predetermined number Q, Q≥0, of future values of the first or initial SNR estimates, i.e., as $$l_k(n)=\max_{0\le i<Q}\{d_k(n+i)\} \tag{12}$$

Figure 5:
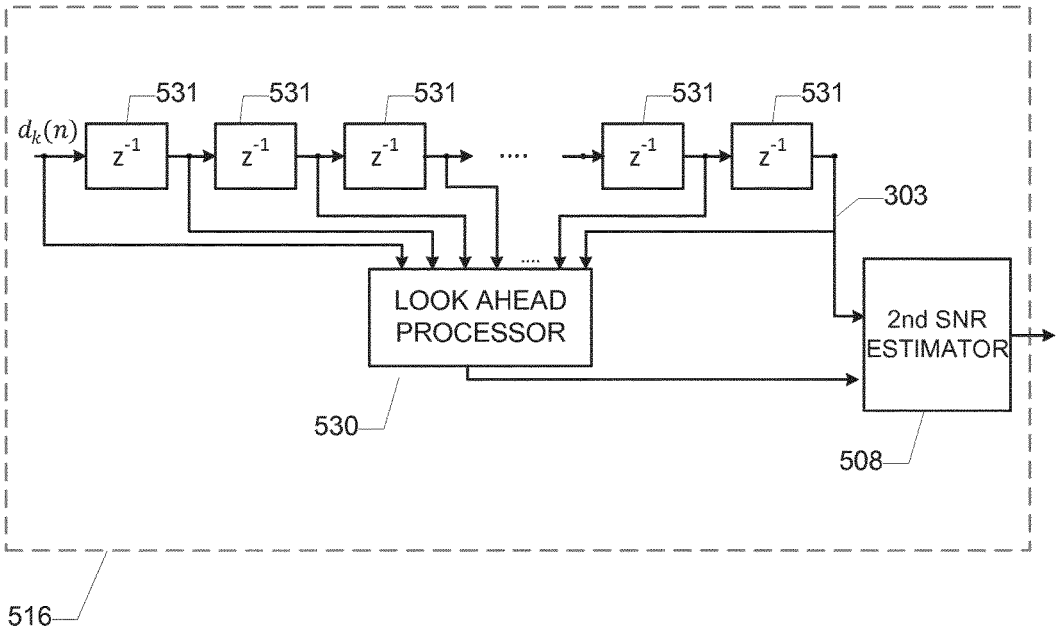
FIG. 5 shows a schematic block diagram of an optional look ahead processor or function of the multi-band noise reduction system of FIG. 7.
Figure 7:
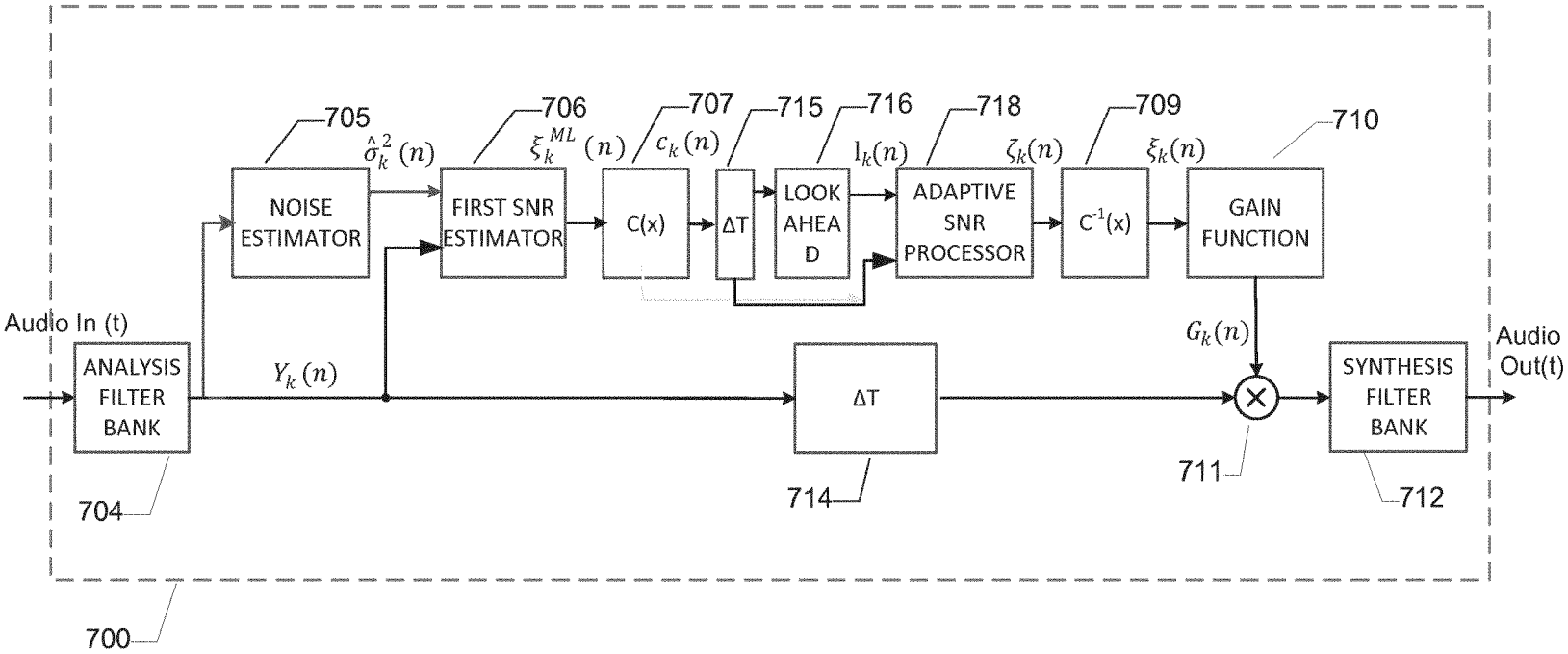
FIG. 7 shows a schematic block diagram of a multi-band noise reduction system in accordance with a second embodiment of the present invention.

In a practical embodiment, this function can be realized using a delay line of Q unit delay elements in a look-ahead processor and an alignment delay inserted in the signal branch. FIG. 5 shows an exemplary look-ahead function 516 and FIG. 7 shows a schematic block diagram of a multi-band noise reduction system 700 comprising the look-ahead function 516 in accordance with a second embodiment of the present invention.

The look-ahead function 516 comprises a tapped delay line of Q unit delay elements 531 and intermediate signal nodes between each pair of neighbouring unit delay elements are connected to the look-ahead processor 530. The look-ahead processor compares all inputs and selects as output the maximum of input values.

The schematic block diagram of the multi-band noise reduction system 700 comprises the same functions or computing blocks as those of the previously discussed multi-band noise reduction system 100. However, a tapped delay line 715 is inserted in-front of the look-ahead function 716 and the tapped delay output of the delay line 715 is connected to inputs of the look-ahead function 716. The final stage of the tapped delay line 715 is coupled directly into the second signal-to-noise ratio estimator 718 to the summing node 223 as indicated on FIGS. 2 and 5. Finally, an alignment delay function or block 714 has been inserted in the direct signal path before the multiplication node 711 of the gain calculator.

The optional sound environment control signal $e_k(n)$ provides an optional, but often advantageous mechanism for adapting time-frequency smoothing and bias to a current noise sound environment. If the noise signal in the current sound environment is relatively stationary, an improved sound quality of the noise reduced digital audio output signal may be achieved by decreasing the values of $x_{f,0}$ and $x_{g,0}$ of $f(x)$. Alternatively, a similar effect may be achieved by adding a sound environment adjustment value $e_k(n)$ as shown in FIG. 2, i.e. a second input to summing function 227, and equation (7). The effect of a positive value of the sound environment control signal, for example 3 dB, is to shift the adaptive filter coefficient value $f(B_k(n))$ and bias value $g(B_k(n))$ towards 1 and 0, respectively. This feature makes the time-varying or adaptive low-pass filtration more sensitive to modulation of speech in the digital audio signal and thereby results in improved clarity of the processed speech of the noise reduced digital audio output signal under stationary environmental noise conditions.

Similarly, the effect of a negative value of the sound environment control signal, for example −3 dB, the adaptive filter coefficient value $f(B_k(n))$ and bias value $g(B_k(n))$ are shifted away from 1 and 0, respectively. This increases robustness of the multi-band noise reduction system for and methodology against small bursts or fluctuations of the environmental background noise. These type of small bursts or fluctuations of the environmental background noise are often present in everyday environmental noise such as traffic or cafeteria noise. In an embodiment, a sound environment processor (523) is used to monitor the background environment noise, to provide the sound environment adjustment value.

The output of the second signal-to-noise ratio estimator 108 is compressed values of the second signal-to-noise ratio estimates $\zeta_k(n)$ of the plurality of sub-band signals $Y_k(n)$. These are processed by a monotonic expansive function 109, 709 matching the monotonic compressive function (107, 707) $C^{-1}(x)$, satisfying $C^{-1}(C(x))=x$. For the exemplary embodiment of $C(x)=10P(x^{1/P}-1)/\log 10$ this is $$\xi_k(n)=C^{-1}(\zeta_k(n))=(\zeta_k(n)\log 10/10P+1)^P \tag{13}$$

The result of the operation of the monotonic expansive function 109, 709 is the second signal-to-noise ratio estimates ζ_k (n) expressed as respective power ratios. The second signal-to-noise ratio estimates ζ_k (n) are applied to, and processed by, a gain calculator or function 110, 710 which is configured to apply respective time-varying gains G_k (n) to the plurality of sub-band signals Y_k (n) in accordance with respective sub-band gain laws to produce a plurality of noise compensated sub-band signals. In one exemplary embodiment, the sub-band gain laws are based on a capped Wiener filter according to:

$$G_k(n)=\max\left(G_{min},\ \frac{\xi_k(n)}{\xi_k(n)+1}\right) \tag{14}$$

where $G_{min}$ is a predetermined minimum gain such as $G_{min}=0.1$.

The determined time-varying gain value is subsequently multiplied with delayed or un-delayed versions of the plurality of sub-band signals $Y_k(n)$ produced by the analysis filter bank 104, 704.

Finally, the noise reduced digital audio output signal is reconstructed by a suitable synthesis filter bank 112, 712 combining the plurality of noise compensated sub-band signals.

REFERENCES

[1] Ephraim, Y.; Malah, D.; "Speech enhancement using a minimum-mean square error short-time spectral amplitude estimator," Acoustics, Speech and Signal Processing, IEEE Transactions on, vol. 32, no. 6, pp. 1109-1121, December 1984

[2] Ephraim, Y.; Malah, D.; "Speech enhancement using a minimum mean-square error log-spectral amplitude estimator," Acoustics, Speech and Signal Processing, IEEE Transactions on, vol. 33, no. 2, pp. 443-445, April 1985

[3] Breithaupt, C.; Martin, R.; "Analysis of the Decision-Directed SNR Estimator for Speech Enhancement With Respect to Low-SNR and Transient Conditions," Audio, Speech, and Language Processing, IEEE Transactions on, vol. 19, no. 2, pp. 277-289, February 2011

[4] Loizou, P. (2007). Speech Enhancement: Theory and Practice, CRC Press, Boca Raton: Fla.

[5] R. Martin, "Noise power spectral density estimation based on optimal smoothing and minimum statistics," IEEE Trans. Speech Audio Processing, vol. 9, no. 5, pp. 504-512, July 2001.

The invention claimed is:

1. A multi-band noise reduction system for digital audio signals, comprising:

a signal input for receipt of a digital audio input signal comprising a target signal and a noise signal;

an analysis filter bank configured for dividing the digital audio input signal into a plurality of sub-band signals $Y_k(n)$;

a noise estimator configured for determining respective sub-band noise estimates $\hat{\sigma}_k^2(n)$ of the plurality of sub-band signals $Y_k(n)$;

a first signal-to-noise ratio estimator configured for determining respective first signal-to-noise ratio estimates $\xi_k^0(n)$ of the plurality of sub-band signals based on the respective sub-band noise estimation signals and the respective sub-band signals $Y_k(n)$;

a second signal-to-noise ratio estimator configured for filtering the plurality of first signal-to-noise ratio estimates $\xi_k^0(n)$ of the plurality of sub-band signals $Y_k(n)$ with respective time-varying low-pass filters to produce respective second signal-to-noise ratio estimates $\zeta_k(n)$ of the plurality of sub-band signals $Y_k(n)$ wherein a low-pass cut-off frequency of each of the time-varying low-pass filters is adaptable in accordance with the first signal-to-noise ratio estimate and/or the second signal-to-noise ratio estimate of the sub-band signal;

a gain calculator configured for applying respective time-varying gains $G_k(n)$ to the plurality of sub-band signals $Y_k(n)$ based on the respective second signal-to-noise ratio estimates $\zeta_k(n)$ and respective sub-band gain laws to produce a plurality of noise compensated sub-band signals; and a synthesis filter bank configured to combine the plurality of noise compensated sub-band signals into a noise reduced digital audio output signal at a signal output.

2. A multi-band noise reduction system according to claim 1, wherein the second signal-to-noise ratio estimator is configured to, for each of the plurality of sub-band signals $Y_k(n)$, increase the low-pass cut-off frequency of the time-varying low-pass filter with increasing values of the first and/or second signal-to-noise ratio estimates of the sub-band signal.

3. A multi-band noise reduction system according to claim 1, wherein each of the plurality of time-varying low-pass filters comprises an IIR filter structure wherein an input of the IIR filter structure is coupled to the first signal-to-noise ratio estimate and an output of the IIR filter structure produces the second signal-to-noise ratio estimate.

4. A multi-band noise reduction system according to claim 3, wherein the IIR filter structure comprises:

a first input summing node configured for receipt of the first signal-to-noise ratio estimate;

an output node supplying the second signal-to-noise ratio estimate;

a unit delay function coupled to the output node and configured to supply a delayed second signal-to-noise ratio estimate to the first input summing node, the input summing node configured to combine an output signal of the first input summing node and the delayed second signal-to-noise ratio estimate to generate a first intermediate signal;

a multiplication function configured to multiply the first intermediate signal and a limited delayed second signal-to-noise ratio estimate to generate a second intermediate signal;

a first intermediate summing node configured to combine the second intermediate signal and the delayed second signal-to-noise ratio estimate;

a maximum operator configured for:

at a first input, receipt of the delayed second signal-to-noise ratio estimate and at a second input, receipt of the first signal to noise-ratio estimate or a look-ahead estimate of the first signal to noise-ratio estimate; and generating a maximum signal-to-noise ratio estimate from the first and second inputs; and a first feedback path configured to couple a first time-varying portion of the maximum signal-to-noise ratio estimate to the multiplication function by a time-varying transfer coefficient of a first monotonic function in accordance with the first signal-to-noise ratio estimate of the sub-band signal.

5. A multi-band noise reduction system according to claim 4, wherein the IIR filter structure further comprises:

a second input summing node arranged in front of the first input summing node and configured for receipt of the first signal-to-noise ratio estimate and a second time-varying portion of the limited delayed second signal-to-noise ratio estimate; and a second feedback path configured to couple the second time-varying portion of the limited delayed second signal-to-noise ratio estimate to the second input summing node by a second monotonic function in accordance with a time-varying transfer coefficient value derived from the first signal-to-noise ratio estimate of the sub-band signal.

6. A multi-band noise reduction system according to claim 1, further comprising:

a monotonic compressive function C(x) arranged in front of the second signal-to-noise ratio estimator and configured for mapping a numerical range of each of the plurality of first signal-to-noise ratio estimates $\xi_k^0(n)$ into a smaller output numerical range before application to the second signal-to-noise ratio estimator; and a monotonic expansive function $C^{-1}(x)$, possessing an inverse transfer characteristic of the monotonic compressive function, arranged after the second signal-to-noise ratio estimator and configured for mapping a numerical range of each of the plurality of second signal-to-noise ratio estimates $\zeta_k(n)$ into a larger output numerical range before application to the gain calculator.

7. A multi-band noise reduction system according to claim 6, wherein the monotonic compressive function C(x) comprises a logarithmic function.

8. A multi-band noise reduction system according to claim 6, wherein the monotonic compressive function C(x) comprises a non-logarithmic function such as:

$$C(x)=10P(x^{1/P}-1)/\log 10,$$

where P>1 and is a positive real number.

9. A multi-band noise reduction system according to claim 1, wherein the gain calculator is configured for computing the respective time-varying gains $G_k(n)$ of the plurality of sub-band signals $Y_k(n)$ according to:

$$G_k(n) = \max\left(G_{min}, \frac{\xi_k(n)}{\xi_k(n)+1}\right);$$

wherein $G_{min}$ is a predetermined minimum gain value between 0.01 and 0.2.

10. A method of reducing noise of a digital audio signal comprising a target signal and a noise signal, comprising steps of:

a) dividing or splitting the digital audio input signal into a plurality of sub-band signals $Y_k(n)$;

b) determining respective sub-band noise estimates $\hat{\sigma}_k^2(n)$ of the plurality of sub-band signals $Y_k(n)$;

c) determining respective first signal-to-noise ratio estimates $\xi_k^0(n)$ of the plurality of sub-band signals based on the respective sub-band noise estimation signals and the respective sub-band signals $Y_k(n)$;

d) filtering the plurality of first signal-to-noise ratio estimates $\xi_k^0(n)$ of the plurality of sub-band signals $Y_k(n)$ with respective time-varying low-pass filters to produce respective second signal-to-noise ratio estimates $\zeta_k(n)$ of the plurality of sub-band signals $Y_k(n)$ wherein a low-pass cut-off frequency of each of the time-varying filters is adapted in accordance with the first signal-to-noise ratio estimate of the sub-band signal;

e) applying respective time-varying gains $G_k(n)$ to the plurality of sub-band signals $Y_k(n)$ based on the respective second signal-to-noise ratio estimates $\zeta_k(n)$ and respective sub-band gain laws to produce a plurality of noise compensated sub-band signals; and f) combining the plurality of noise compensated sub-band signals into a noise reduced digital audio output signal at a signal output.

11. A method of reducing noise of a digital audio input signal according to claim 10 comprising further steps of:

before step d) mapping a numerical range of each of the plurality of first signal-to-noise ratio estimates $\xi_k^0(n)$ into a smaller output numerical range in accordance with a monotonic compressive function; and before step e) mapping a numerical range of each of the plurality of second signal-to-noise ratio estimates $\zeta_k(n)$ into a larger output numerical range in accordance with a monotonic expansive function possessing an inverse transfer characteristic of the monotonic compressive function.

12. A processor-readable tangible non-transient medium storing a computer program for operating a programmable signal processor, the computer program comprising instructions for causing the programmable signal processor to execute each of the method steps a)-f) of claim 10.

* * * * *